US008669714B2

(12) United States Patent
Trinschek

(10) Patent No.: US 8,669,714 B2
(45) Date of Patent: Mar. 11, 2014

(54) METHOD FOR DIMMING A LIGHT-EMITTING DIODE ARRANGEMENT OF A MOTOR VEHICLE

(75) Inventor: Martin Trinschek, Hamm (DE)

(73) Assignee: Hella KGAA Hueck & Co., Lippstadt (DE)

( * ) Notice: Subject to any disclaimer, the term of this patent is extended or adjusted under 35 U.S.C. 154(b) by 829 days.

(21) Appl. No.: 12/740,589

(22) PCT Filed: Oct. 31, 2008

(86) PCT No.: PCT/EP2008/064772

§ 371 (c)(1), (2), (4) Date: May 14, 2010

(87) PCT Pub. No.: WO2009/056618

PCT Pub. Date: May 7, 2009

(65) Prior Publication Data

US 2010/0301750 A1 Dec. 2, 2010

(30) Foreign Application Priority Data

Nov. 2, 2007 (DE) ..... 10 2007 052 434

(51) Int. Cl.
*H05B 41/36* (2006.01)

(52) U.S. Cl.
USPC ..... 315/209 R; 315/291; 315/297; 315/302

(58) Field of Classification Search
USPC ..... 315/209 R, 291, 297, 307, 362
See application file for complete search history.

(56) References Cited

U.S. PATENT DOCUMENTS

| | | | | |
|---|---|---|---|---|
| 5,783,909 | A | 7/1998 | Hochstein | |
| 7,535,443 | B2 * | 5/2009 | Lindqvist | 345/82 |
| 2005/0088209 | A1 | 4/2005 | Wessels | |
| 2005/0134188 | A1 * | 6/2005 | Lindqvist | 315/149 |
| 2005/0156531 | A1 | 7/2005 | Young | |
| 2005/0231133 | A1 | 10/2005 | Lys | |
| 2007/0103086 | A1 | 5/2007 | Neudorf et al. | |
| 2007/0138979 | A1 | 6/2007 | Yamada et al. | |
| 2007/0188114 | A1 | 8/2007 | Lys et al. | |

FOREIGN PATENT DOCUMENTS

| | | | |
|---|---|---|---|
| DE | 10215472 | A1 | 11/2003 |
| DE | 10349553 | A1 | 1/2005 |
| DE | 102004028987 | A1 | 1/2006 |
| GB | 2408315 | A | 5/2005 |

* cited by examiner

*Primary Examiner* — Douglas W Owens
*Assistant Examiner* — Jianzi Chen
(74) *Attorney, Agent, or Firm* — Husch Blackwell LLP; Robert C. Haldiman; H. Frederick Rusche

(57) ABSTRACT

The invention concerns a process to dim a light emitting diode device of a motor vehicle. In order to keep changes of the light intensity from being noticeable, they must be appropriately small. Electronic dimmers with pulse width modulation have historically required a microcontroller with a pulse width modulation generator with at least 10 bits. In order to use cheaper controllers, the invention proposes that the pulse width signal be modulated as a function of a variable on-period and a simultaneously variable period length.

2 Claims, 1 Drawing Sheet

METHOD FOR DIMMING A LIGHT-EMITTING DIODE ARRANGEMENT OF A MOTOR VEHICLE

CROSS REFERENCE TO RELATED APPLICATIONS

Figure 1:
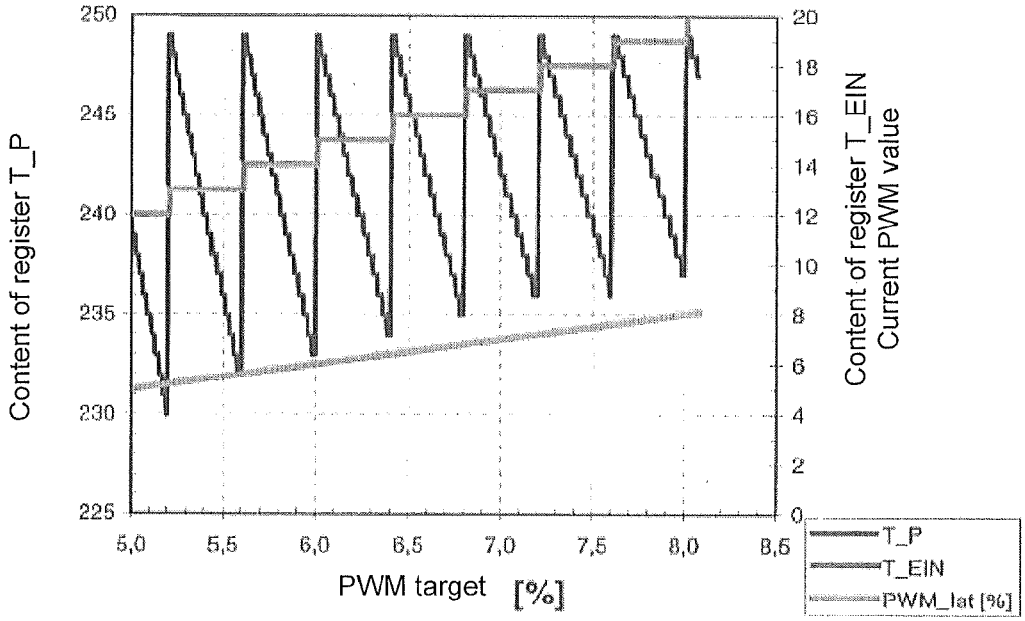

This application is a U.S. National Phase Application of International Application PCT Application No. PCT/EP2008/064772 filed on Oct. 31, 2008, which claims the benefit of priority from German Patent Application No. 10 2007 052 434.1 filed on Nov. 2, 2007. The disclosures of International Application PCT Application No. PCT/EP2008/064772 and German Patent Application No. 10 2007 052 434.1 are incorporated herein by reference.

The invention concerns a process to dim a light emitting diode device for a motor vehicle as defined in Claim 1.

Light emitting diode devices have been used more and more often in motor vehicles for various functions. In some cases, it has become necessary to dim the light intensity of the light emitting diode device in order to conform it to ambient conditions. It should be feasible to make the various light adjustments on a continuous basis without noticeable jumps. This implies that the change in light intensity may not exceed 2% of the current light intensity. This is particularly critical at lower levels of the light intensity.

DE 102 15 472 B4 publishes a blinker control, where at least one of the blinker bulbs is replaced by light emitting diodes. In order to have the blinker operate appropriately, a light bulb current to be supplied to the light emitting diodes must be simulated. This can be achieved by controlling a current flow by means of an electric load such that a pulse width of a periodic signal is modulated with respect to time in accordance with the current characteristic curve of the blinker bulb that was replaced.

DE 10 2004 028 987 A1 describes a process to control a lighting device containing at least one light emitting diode, where the input current is adjusted according to the outside temperature. Here, the current or the pulse duty factor of a pulse width modulation is adjusted according to the outside temperature.

It is known to handle the dimming of lights by way of a digital pulse width modulation. In order to dim lights without steps and without noticeable jumps in light intensity when light emitting diodes are used as light bulbs, the known pulse width modulators require the use of microcontrollers with a resolution of at least 10 bit or 1023 light intensity steps. This applies particularly for the lower range of the light intensity, where each step implies a relative large change in terms of percentages. These microcontrollers are correspondingly relatively expensive.

The invention has the objective to generate a process to dim a light emitting diode device that permits the use of simple and cheap electronic elements.

The objective is solved by the characteristics of Claim 1. The pulse width signal is modified as a function of the specified target value by a variable on-period and a simultaneously variable period length. This means that each change of the target value of the pulse width modulation will change the on-period and will also change the period length. This leads to a reduction in the jump at each change, such that even the use of a cheaper 8 bit microcontroller can generate a pulse width modulation that assures satisfactory small and thus imperceptible jumps in light intensity even in the lower range.

The computations of Claim 2 are simple to undertake and facilitate an effective reduction in the jumps.

Saving the values in memory reduces the required computing capacity and can be done easily.

8 bit microcontrollers are cheap compared to the 16 bit embodiments.

Figure 2:
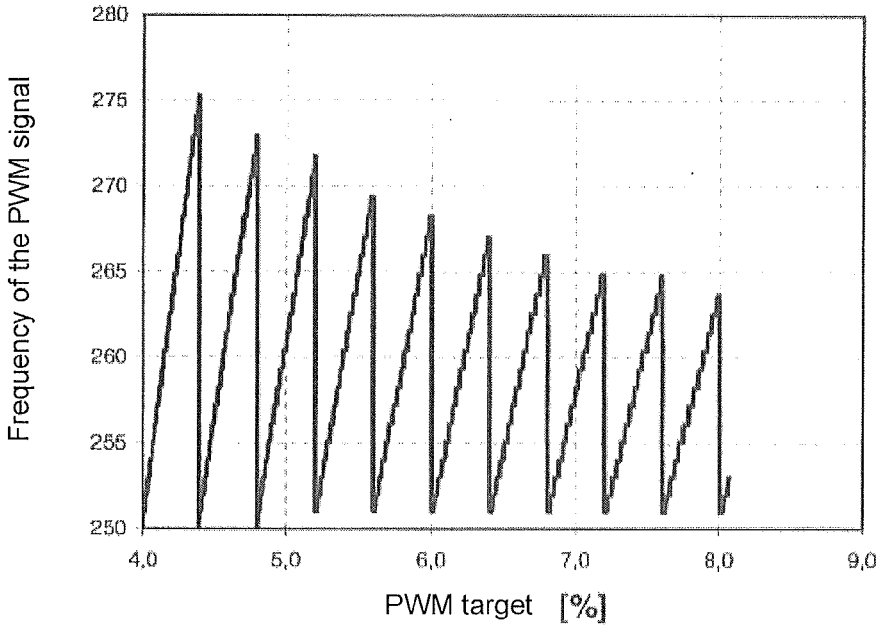

The invention is described in more detail be reference to the enclosed drawings. They show:

FIG. 1 a diagram of the on-period, the period length and the resulting pulse width modulation and FIG. 2 a resulting frequency of a pulse-width modulated signal.

A motor vehicle includes light emitting diode devices in its front headlights, for example. The light emitting diode devices are intended to generate a day drive light with 100% light intensity, on the one hand, and a significantly weaker position light, on the other hand. This position light is intended to produce 4 to 10% of the light intensity of the day drive light and should be adjustable depending on the changing outside conditions. These adjustments should not be discernable by the human eye.

The light intensity of the light emitting diode devices is controlled by pulse width modulation (PWM) generated by an 8 bit microcontroller. The modulation is handled by changing the on-period $T_{ein}$ and the period length $T_P$ as a function of a pre-specified target value, where the values are computed once and are then stored in a storage device linked to the microcontroller.

The computation uses the following formulas:

$$T_{ein}=N(T_{ein\text{-}soll}*T_{ein\text{-}max}/100)$$

$$T_P=N(100*T_{ein}/T_{ein\text{-}soll})$$

N denotes here the formation of an integer derived as a rounded value from the value computed in the following parentheses, because the pulse width modulation storage device of the microcontroller can handle only integer values. $T_{ein\text{-}soll}$ is a target value of the pulse width modulation and ranges from 0 to 100%. $T_{ein\text{-}max}$ is an integer ranging from 0 to 250, denotes the maximum period length, and will define the minimal frequency of the pulse width modulation signal in conjunction with the frequency of the pulse width modulation of the microcontroller.

FIG. 1 shows the computed values for the on-period $T_{ein}$ and the period length $T_P$ as a function of the pulse width modulation target value between 5 and 8%. The on-period $T_{ein}$ increases stepwise in this range from 12 to 20%, where each step represents a jump in the on-period $T_{ein}$ of 1%.

The graph of the period length $T_P$ has a saw-tooth plot, where each step corresponds to a tooth; the period length $T_P$ varies between 230 and 250. It declines over the progression of the step from 250 to the lower value and then suddenly jumps back up to 250.

The current value of the pulse width modulation control output in % corresponds to the target value.

The frequency of the pulse width modulation signal resulting from the on-period $T_{ein}$ and the period length $T_P$ of FIG. 1 is shown in FIG. 2. It is obvious that the frequency of the pulse width modulation signal is significantly higher, particularly in the range of short on-periods $T_{ein}$, than without the simultaneous change of the on-period $T_{ein}$ and the period length $T_P$ as proposed by the invention.

The invention claimed is:

1. A process to dim a light emitting diode device for a motor vehicle, where the brightness of the light emitting diodes is adjusted continuously, said process comprising;

providing a pulse width signal emitted by a digital pulse width modulator;

modulating the pulse width signal as a function of a specified target value with a variable on-period ($T_{ein}$) and a simultaneously correspondingly variable period length ($T_P$);

computing the on-period ($T_{ein}$) from the formula $T_{ein}$=N ($T_{ein\text{-}soll}$*$T_{ein\text{-}max}$/100) and the period length ($T_P$) from the formula $T_P$=N (100*$T_{ein}$/$T_{ein\text{-}soll}$), where N denotes the formation of an integer derived from the following value in parentheses, $T_{ein\text{-}soll}$ is a target value in % for the current on-period, and $T_{ein\text{-}max}$ is a maximum period length; and whereby the brightness of the light emitting diode may be changed without perceptible jumps in light intensity.

2. The process to dim a light emitting diode device of claim 1, further comprising:

storing the computed values for the on-period ($T_{ein}$) and the period length ($T_P$) in a storage medium linked to the pulse width modulator.

* * * * *

UNITED STATES PATENT AND TRADEMARK OFFICE

CERTIFICATE OF CORRECTION

PATENT NO. : 8,669,714 B2
APPLICATION NO. : 12/740589
DATED : March 11, 2014
INVENTOR(S) : Martin Trinschek It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 840 days.

Signed and Sealed this
Twenty-ninth Day of September, 2015

Michelle K. Lee

Michelle K. Lee
*Director of the United States Patent and Trademark Office*